United States Patent [19]

Greis et al.

[11] Patent Number: 4,458,886

[45] Date of Patent: Jul. 10, 1984

[54] THERMAL RECUPERATOR DEVICE WITH A FACILITY FOR CONTROLLING THE PRESSURE IN AN UPSTREAM VESSEL

[75] Inventors: Ingemar Greis; Klaus Koberstein, both of Sturefors, Sweden

[73] Assignee: ASEA AB, Västerås, Sweden

[21] Appl. No.: 449,566

[22] Filed: Dec. 13, 1982

[30] Foreign Application Priority Data

Dec. 14, 1981 [SE] Sweden ..... 8107466

[51] Int. Cl.[3] ..... C21C 5/38

[52] U.S. Cl. ..... 266/158

[58] Field of Search ..... 266/158, 155, 156, 159; 432/29, 179, 223; 165/155

[56] References Cited

U.S. PATENT DOCUMENTS

| | | | |
|---|---|---|---|
| 2,128,129 | 8/1938 | Farley | 266/158 |
| 3,143,411 | 8/1964 | Hoff | 266/158 |
| 3,446,279 | 5/1969 | White et al. | 165/155 |
| 4,015,932 | 4/1977 | Zurawski | 432/179 |
| 4,325,430 | 4/1982 | Husa | 165/155 |

FOREIGN PATENT DOCUMENTS 2005393 4/1979 United Kingdom .

*Primary Examiner*—L. Dewayne Rutledge
*Assistant Examiner*—Robert L. McDowell
*Attorney, Agent, or Firm*—Watson, Cole, Grindle & Watson

[57] ABSTRACT

A thermal recuperator for heating gas supplied to a vessel from which a hot gas is discharged and which allows the pressure in the vessel to be controlled substantially without regard to the pressure drop necessary to cause the hot gas to flow through the recuperator. The invention has particular utility in the case of a metallurgical ladle provided with a ladle heater, the combustion air for which is heated in a recuperator receiving waste gas from the ladle. A conduit for the waste gas leaving the ladle is surrounded by one or more conduits for the combustion air, and an ejector fed with combustion air is arranged at the gas outlet of the waste gas conduit to accelerate the waste gases and facilitate their egress from the recuperator.

11 Claims, 6 Drawing Figures

FIG. 1
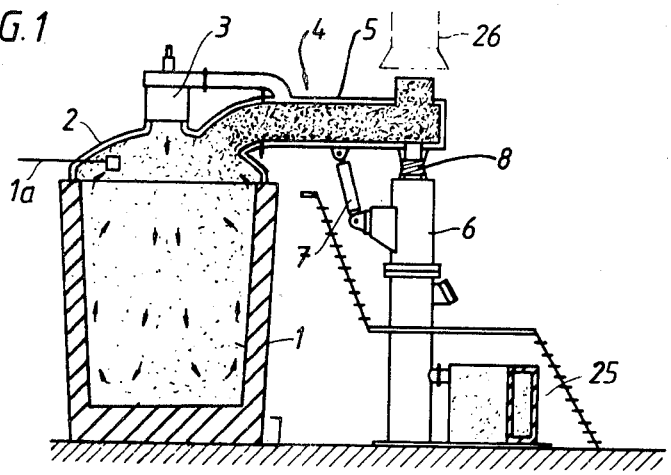
FIG. 2
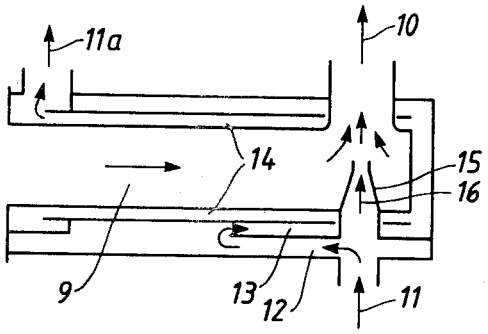
FIG. 3
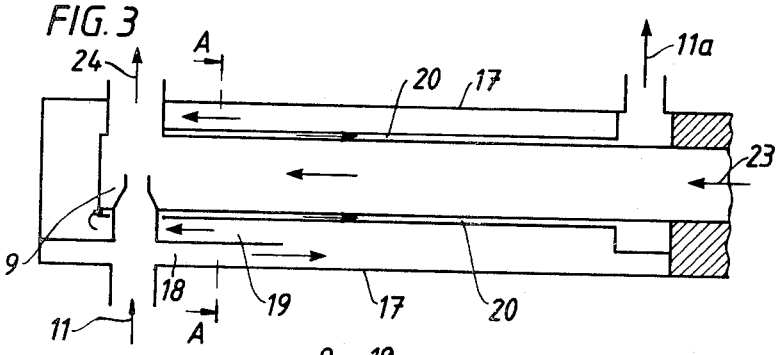
FIG. 4
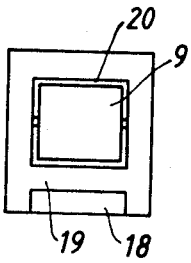
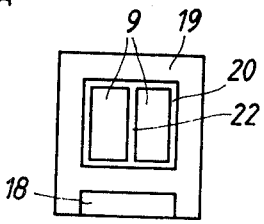
FIG. 5
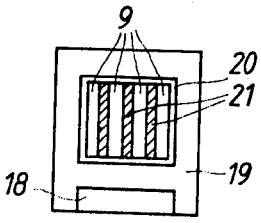
FIG. 6

THERMAL RECUPERATOR DEVICE WITH A FACILITY FOR CONTROLLING THE PRESSURE IN AN UPSTREAM VESSEL

TECHNICAL FIELD

The present invention relates to a thermal recuperator device with a facility for controlling the pressure in an upstream vessel feeding hot gas to the device. The invention has particular utility in preheating combustion air fed to a burner of a metallurgical ladle, converter, or the like melt container (hereafter for convenience referred to simply as a "ladle").

A thermal recuperator device for use with a ladle is known from British Pat. No. 2,005,393.

When using a conventional thermal recuperator, the more thermally efficient the recuperator, the greater the dynamic pressure drop occurring across it will be. The pressure drop arising on the waste gas side manifests itself as an overpressure in the vessel supplying the waste gas, which heightens the problem of providing a good seal between the hood covering the vessel and the vessel.

The present invention seeks to provide an improved thermal recuperator device which provides efficient heat recovery without inducing an excessive pressure rise in the source vessel.

BRIEF STATEMENTS OF INVENTION

According to the invention there is provided a thermal recuperator device for heating a gas supplied to a vessel with thermal energy extracted from gas exiting from the vessel without inducing an excessive pressure rise in the vessel, which recuperator comprises first conduit means for the exiting gas, a hood for the vessel forming an inlet for the first conduit means, a first outlet at the downstream end of the first conduit means, second conduit means in heat-exchange relationship with the first conduit means, a gas inlet for the second conduit means, a second outlet from the second conduit means, duct means leading from the second outlet to the hood, and an ejector directing gas flows towards the first outlet, the ejector being fed with gas and acting to accelerate the flow of gas through the first outlet.

Suitably the gas feed for the ejector is drawn from the gas inlet to the second conduit means and the second conduit means surrounds the first conduit means.

According to a further aspect of the invention, when used with an open-topped ladle, there is provided a hood adapted to receive hot waste gas from the ladle, a support arm for the hood, and a burner mounted on the hood and receiving combustion air from the support arm; the support arm serving as a thermal recuperator transferring thermal energy from the waste gas leaving the hood to the combustion air fed to the hood, which is characterized in that egress of the waste gas from the thermal recuperator is assisted by an ejector fed with air drawn from the combustion air supplied to the thermal recuperator.

By using part of the combustion air in an ejector placed at the outlet of the thermal recuperator, the pressure drop in the waste gas conduit of the thermal recuperator can be compensated for and the pressure in the hood be maintained substantially at ambient (e.g. atmospheric) pressure. In this way leakage between the hood and the ladle is substantially avoided. The ejector can be made automatically adjustable to control the pressure in the hood and ladle.

In a preferred embodiment, the combustion air conduit means is arranged as a number of series- and/or parallel-connected conduits, separated by longitudinal walls, for example with the conduit which is arranged last in the air flow located closest to the waste gas conduit means. Suitably this last conduit for combustion air has a reduced cross-section for the purpose of increasing the air speed therein. In this way, a relatively low temperature can be obtained at the outer surface of this combustion air conduit, despite a high waste gas temperature.

BRIEF DESCRIPTION OF DRAWING

The invention will be exemplified in greater detail, by way of example, with reference to the accompanying drawing, in which:

FIG. 1 shows a metallurgical ladle with a thermal recuperator seen in side section, FIG. 2 shows, schematically, a longitudinal cross-section of the recuperator of FIG. 1, FIG. 3 shows a modified embodiment of the recuperator, FIG. 4 shows a transverse cross-section through the recuperator of FIG. 3, and FIGS. 5 and 6 show modified cross-sections for recuperators similar to that shown in FIG. 3.

DESCRIPTION OF PREFERRED EMBODIMENTS

FIG. 1 shows a metallurgical ladle 1 with a hood 2 disposed, suitably in a gas-tight manner, over the open top of the ladle 1. A gas inlet 3 passed through the hood 2 to direct a stream of gas (e.g. a flame) downwardly into the ladle. The gas inlet 3 (e.g. a burner) may be disposed to direct the gas stream centrally of the ladle's cross-sectional area (as shown) but other dispositions are also possible. The hood 2 is connected to a support arm 5, which defines one or more inner gas exit channels surrounded by one or more gas supply channels to the inlet 3 (e.g. for combustion air for a burner). The hood 2 and the arm 5 together form a thermal recuperator 4 in which the exit or waste gas channel(s) and the inlet or combustion air channel(s) is/are arranged in mutual heat exchange relationship. Since the hot exiting gas is shielded from the outer shell of the support arm 5 by the colder inlet gas, the outer shell can be made of a normal steel without impairing the bending strength of the outer shell, so that expensive heat resistant material need only be used to define the inner gas exit channel(s). The support arm 5 is movably (e.g. turnably) mounted on a support column 6, and is stayed with respect thereto by a hydraulic piston-in-cylinder device 7 which allows a lifting and lowering of the support arm 5 and the hood 2. The support arm 5 is provided, in a known manner, with a hinge means 8 for providing the movable connection with the support column 6.

The combustion air required for the burner 3 is drawn from the atmosphere through a fan/filter unit 25 at the base of the column 6, and is pre-heated in the recuperator section 4 of the arm 5 by the waste gas from the ladle which exists from the support arm 5 upwardly into a vent 26.

The heat-exchange region of the recuperator 4 is shown schematically in greater detail in FIG. 2. The exit or waste gas conduit is shown at 9 and the exiting gas leaving the waste gas outlet is shown by the arrow 10. Inlet or combustion air flows in the direction of the arrow 11 and is distributed among a plurality of inlet air channels 12, 13 and 14, which are shown in FIG. 2 connected in series, but could be connected in parallel or in series and parallel. A proportion of the flow of inlet gas is fed to an ejector 15 and is exhausted in the direction of the arrow 16, thus increasing the speed of the discharge of the waste gas stream through the waste gas outlet. Using the ejector 15 to facilitate expulsion of the exit gas stream from the downstream end of the exit gas channel, means that the recuperator 4 can operate with a reduced pressure at the upstream end of the exit gas channel and thus with a reduced measure of overpressure in the ladle 1. Thus, the ladle 1 can be operated substantially at ambient pressure so that little or no leakage of waste gas will arise between the ladle 1 and the hood 2. Automatic regulation of the gas volume fed to the ejector 15 may be employed, for example, to maintain a certain desired operating pressure in the ladle 1. For example, a suitable pressure transducer (1*a*) may be disposed in the hood 2 to permit such automatic control.

The recuperator 4 can thus be used to preheat combustion air fed to a burner 3 by utilizing the thermal energy conveyed from the ladle 1 by the waste gases flowing in the conduit 9. Preheated air leaves the recuperator 4 at 11*a* and can then be used as combustion air in the burner 3 (see FIG. 1). Since the heat exchange part of the recuperator 4 also serves to carry the weight of the hood 2 with its burner 3, considerable in-use strength demands are placed on the support arm 5. Since the load carried by the arm 5 is largely taken up in the outer shell (see 17 in FIG. 3), the in-use temperature thereof must not exceed certain limits determined by the grade of steel used. A relatively low temperature is possible with a device according to the invention without the need for additional thermal insulation, thus permitting the use of normal grade steels for the outer shell.

FIG. 3 shows the recuperator part of a second embodiment of device, combustion air being admitted in the direction of the arrow 11 and leaves to flow to the ladle in the direction of the arrow 11*a*. In the recuperator, the combustion air passes through a number of series-connected conduits 18, 19 and 20, which are mutually divided by means of longitudinal walls. The downstream conduit 20 is suitably constructed (as shown) with a reduced cross-section to increase the air speed in this inner conduit. The ejector 15 is arranged adjacent to the outlet for the waste gas in a manner similar to that shown in FIG. 2 and acts to facilitate exit of the gas in the direction of the arrow 24. The inlet of the waste gas from the ladle is indicated by the arrow 23.

The length of the support arm 5 (in FIG. 1) or the outer shell 17 (in FIG. 3) is often determined by parameters other than the length necessary for the heat transfer. However, with a design in accordance with the invention, since the length required for heat-exchange purposes can be obtained by appropriate dimensioning of the conduits 18, 19, 20, 9, without regard to the pressure drops induced thereby, the correct preheating temperature can be obtained, and the ejector 15 can be used to provide the required low overall pressure drop. The advantages of a design in accordance with the invention are that it is simple, insensitive to fouling, easy to keep clean and easy to adjust to the required temperature conditions.

FIGS. 4, 5 and 6 show three different possible cross-sections of the support arm along the line A—A in FIG. 3. FIG. 4 shows a cross-section in accordance with FIG. 3 with the waste gas conduit again shown as 9 and the air conduits as 18, 19 and 20, respectively.

The major proportion of the heat transfer to the inlet air occurs while the air is passing through the conduit 20 between the inner shell and the inner tube. The outer shell 17 is protected from direct radiation from the inner tube by the inner shell. The temperature of the outer shell can therefore be maintained at a relatively low value, for example below approximately 100° C.

An improved heat transfer rate can be obtained by providing the inner and outer sides of the inner tube with fins or flanges and/or by dividing the waste gas conduit 9 and the air conduit 20 into a plurality of parallel passages as shown at 22 in FIG. 5 or at 23 in FIG. 6. One possibility for reducing the heat transfer rate is the provision of holes in the thicker portion of the inner shell which communicate with the outlet 24 for the waste gas. Such an arrangement gives a certain flexibility in operation. For example, the proportion of gas leaked into the outlet through the openings may be automatically adjusted with regard to that fed directly to the ejector 15. It is even possible to dispense with the ejector 15 and secure the required improved egress of waste gas purely by way of air fed from the conduit 19 in FIG. 3.

The invention can be varied in many ways within the scope of the following claims, and although the anticipated use of the device is expected to be with metallurgical vessels, it will be appreciated it can be used in any situation where a hot gas leaves a vessel and a gas which needs to be heated has to be fed to that vessel.

What is claimed is:

1. A thermal recuperator device for heating combustion air supplied to a vessel by heat exchange with an exhaust gas exiting the vessel without inducing an excessive pressure rise in the vessel, the recuperature device comprising a first conduit means for the exiting exhaust gas, said first conduit means having a first end positionable near the vessel and a second end positionable remote from the vessel, means at said first end of said first conduit means forming an inlet to said first conduit means and shaped to function as a hood for the vessel, means near said second end of said first conduit means forming an outlet from said first conduit means, a second conduit means for supplying combustion air to the vessel, said second conduit means being positioned in heat exchange relationship with said first conduit means, means forming a combustion gas inlet for said second conduit means, means forming an outlet from said second conduit means, duct means connecting said outlet means from said second conduit means with said hood-shaped inlet means of said first conduit means, and an ejector means connected to said second conduit means and extending into said first conduit means near said second end thereof and directed toward said outlet thereof to provide a flow of combustion gas moving toward said outlet and thereby accelerate the flow of exhaust gas exiting from the vessel along said first conduit means and through the outlet thereof.

2. A device as claimed in claim 1, wherein said ejector means is connected to said means forming the combustion gas inlet for said second conduit means.

3. A device as claimed in claim 2, in which the second conduit means surrounds the first conduit means.

4. A device according to claim 3, in which the first and second conduit means are at least partially arranged in a support arm for the hood of the vessel.

5. A device according to claim 1, in which the second conduit means comprises a plurality of series-connected conduits separated by walls extending in the elongate direction of the first conduit means.

6. A device according to claim 5, in which the downstream conduit of said plurality of conduits has the smallest cross-sectional area and is closest to said first conduit means.

7. A device according to claim 1, in which means is provided to control the combustion gas flow rate through the ejector means.

8. A device according to claim 4, in which means is provided to control the combustion gas flow rate through the ejector means.

9. A device according to claim 5, in which means is provided to control the combustion gas flow rate through the ejector means.

10. In a thermal recuperator device for use with an open-topped ladle, said device including a hood adapted to receive hot waste gas from the ladle, a support arm connected to the hood and including a combustion air feed conduit and a hot waste gas removal conduit which are in heat exchange relationship to one another, and a burner mounted on the hood which receives combustion air from the combustion air feed conduit, the improvement wherein an ejector means extends from the combustion air feed conduit into the hot waste gas removal conduit so as to provide a flow of combustion gas therein to accelerate the flow of hot waste gas along the hot waste gas removal conduit and thereby help maintain the pressure in the hood at a substantially ambient value.

11. A device according to claim 10, in which means is provided to control the combustion gas flow rate through the ejector means.

* * * * *